US007710358B2

(12) United States Patent
Yamada et al.

(10) Patent No.: US 7,710,358 B2
(45) Date of Patent: May 4, 2010

(54) IMAGE DISPLAY APPARATUS FOR CORRECTING DYNAMIC FALSE CONTOURS

(75) Inventors: Kazuhiro Yamada, Takatsuki (JP); Isao Kawahara, Toyono-gun (JP)

(73) Assignee: Panasonic Corporation, Osaka (JP)

( * ) Notice: Subject to any disclaimer, the term of this patent is extended or adjusted under 35 U.S.C. 154(b) by 775 days.

(21) Appl. No.: 10/515,527

(22) PCT Filed: Dec. 26, 2003

(86) PCT No.: PCT/JP03/17017

§ 371 (c)(1),
(2), (4) Date: Nov. 23, 2004

(87) PCT Pub. No.: WO2005/066925

PCT Pub. Date: Jul. 21, 2005

(65) Prior Publication Data

US 2005/0225512 A1 Oct. 13, 2005

(51) Int. Cl.
*G09G 3/28* (2006.01)

(52) U.S. Cl. ..... 345/63; 345/690

(58) Field of Classification Search ..... 345/30, 345/63, 84, 88, 89, 90, 690–694, 594, 60
See application file for complete search history.

(56) References Cited

U.S. PATENT DOCUMENTS 6,069,609 A 5/2000 Ishida et al.
6,340,961 B1 * 1/2002 Tanaka et al. ..... 345/63
7,110,010 B1 * 9/2006 Masuji et al. ..... 345/692
2002/0005842 A1 * 1/2002 Honda et al. ..... 345/204
2002/0005854 A1 * 1/2002 Deering et al. ..... 345/596
2002/0135595 A1 9/2002 Morita et al.

FOREIGN PATENT DOCUMENTS

EP 1 696 407 A1 8/2006
JP 8-115058 A 5/1996
JP 2003-338929 A 11/2003
WO WO 00/43979 7/2000

OTHER PUBLICATIONS

Japanese language International Search Report for PCT/JP03/17017, dated Apr. 4, 2004.
Japanese language International Search Report for PCT/JP03/17017, dated Apr. 20, 2004.
Supplementary European Search Report for Application No. EP 03 78 9637 dated Jul. 23, 2008.

* cited by examiner

*Primary Examiner*—Regina Liang
(74) *Attorney, Agent, or Firm*—RatnerPrestia

(57) ABSTRACT

An image display apparatus, such as a plasma display panel, suppresses dynamic false contours with gradation levels sufficiently retained. The image display apparatus has agitation constant adder for generating a plurality of agitation constants for a gradation level corresponding to an image signal, for selecting one agitation constant therefrom, and for adding the agitation constant to the image signal. As a result, dynamic false contours can not be visually perceived because their portions are dispersed by superimposing an agitation to each image signal.

6 Claims, 23 Drawing Sheets

FIG. 2A

| Original gradation level | Subfield | | | | | | | | | | Display-use gradation level (a) | Display-use gradation level (b) |
|---|---|---|---|---|---|---|---|---|---|---|---|---|
| | 1 | 2 | 3 | 4 | 5 | 6 | 7 | 8 | 9 | 10 | | |
| | 1 | 2 | 4 | 8 | 16 | 25 | 34 | 44 | 55 | 66 | | |
| 0 | | | | | | | | | | | • | • |
| 1 | 1 | | | | | | | | | | • | • |
| 2 | | 1 | | | | | | | | | | • |
| 3 | 1 | 1 | | | | | | | | | • | • |
| 4 | | | 1 | | | | | | | | | |
| 5 | 1 | | 1 | | | | | | | | | • |
| 6 | | 1 | 1 | | | | | | | | | • |
| 7 | 1 | 1 | 1 | | | | | | | | • | • |
| 8 | | | | 1 | | | | | | | | |
| 9 | 1 | | | 1 | | | | | | | | |
| 10 | | 1 | | 1 | | | | | | | | |
| 11 | 1 | 1 | | 1 | | | | | | | | • |
| 12 | | | 1 | 1 | | | | | | | | |
| 13 | 1 | | 1 | 1 | | | | | | | | • |
| 14 | | 1 | 1 | 1 | | | | | | | | • |
| 15 | 1 | 1 | 1 | 1 | | | | | | | • | • |
| 16 | | | | | 1 | | | | | | | |
| 17 | 1 | | | | 1 | | | | | | | |
| 18 | | 1 | | | 1 | | | | | | | |
| 19 | 1 | 1 | | | 1 | | | | | | | |
| 20 | | | 1 | | 1 | | | | | | | |
| 21 | 1 | | 1 | | 1 | | | | | | | |
| 22 | | 1 | 1 | | 1 | | | | | | | |
| 23 | 1 | 1 | 1 | | 1 | | | | | | | • |
| 24 | | | | 1 | 1 | | | | | | | |
| 25 | 1 | | | 1 | 1 | | | | | | | |
| 26 | | 1 | | 1 | 1 | | | | | | | |
| 27 | 1 | 1 | | 1 | 1 | | | | | | | • |

FIG. 2B

| Original gradation level | Subfield | | | | | | | | | | Display-use gradation level (a) | Display-use gradation level (b) |
|---|---|---|---|---|---|---|---|---|---|---|---|---|
| | 1 | 2 | 3 | 4 | 5 | 6 | 7 | 8 | 9 | 10 | | |
| | 1 | 2 | 4 | 8 | 16 | 25 | 34 | 44 | 55 | 66 | | |
| 28 | | | 1 | 1 | 1 | | | | | | | |
| 29 | 1 | | 1 | 1 | 1 | | | | | | | • |
| 30 | | 1 | 1 | 1 | 1 | | | | | | | • |
| 31 | 1 | 1 | 1 | 1 | 1 | | | | | | • | • |
| 32 | 1 | 1 | 1 | | | 1 | | | | | | |
| 33 | | | | 1 | | 1 | | | | | | |
| 34 | 1 | | | 1 | | 1 | | | | | | |
| 35 | | 1 | | 1 | | 1 | | | | | | |
| 36 | 1 | 1 | | 1 | | 1 | | | | | | |
| 37 | | | 1 | 1 | | 1 | | | | | | |
| 38 | 1 | | 1 | 1 | | 1 | | | | | | |
| 39 | | 1 | 1 | 1 | | 1 | | | | | | |
| 40 | 1 | 1 | 1 | 1 | | 1 | | | | | | • |
| 41 | | | | | 1 | 1 | | | | | | |
| 42 | 1 | | | | 1 | 1 | | | | | | |
| 43 | | 1 | | | 1 | 1 | | | | | | |
| 44 | 1 | 1 | | | 1 | 1 | | | | | | |
| 45 | | | 1 | | 1 | 1 | | | | | | |
| 46 | 1 | | 1 | | 1 | 1 | | | | | | |
| 47 | | 1 | 1 | | 1 | 1 | | | | | | |
| 48 | 1 | 1 | 1 | | 1 | 1 | | | | | | • |
| 49 | | | | 1 | 1 | 1 | | | | | | |
| 50 | 1 | | | 1 | 1 | 1 | | | | | | |
| 51 | | 1 | | 1 | 1 | 1 | | | | | | |
| 52 | 1 | 1 | | 1 | 1 | 1 | | | | | | • |
| 53 | | | 1 | 1 | 1 | 1 | | | | | | |
| 54 | 1 | | 1 | 1 | 1 | 1 | | | | | | • |
| 55 | | 1 | 1 | 1 | 1 | 1 | | | | | | • |

FIG. 2C

| Original gradation level | Subfield | | | | | | | | | | Display-use gradation level (a) | Display-use gradation level (b) |
|---|---|---|---|---|---|---|---|---|---|---|---|---|
| | 1 | 2 | 3 | 4 | 5 | 6 | 7 | 8 | 9 | 10 | | |
| | 1 | 2 | 4 | 8 | 16 | 25 | 34 | 44 | 55 | 66 | | |
| 56 | 1 | 1 | 1 | 1 | 1 | 1 | | | | | • | • |
| 57 | 1 | 1 | 1 | | 1 | | 1 | | | | | |
| 58 | | | | 1 | 1 | | 1 | | | | | |
| 59 | 1 | | | 1 | 1 | | 1 | | | | | |
| 60 | | 1 | | 1 | 1 | | 1 | | | | | |
| 61 | 1 | 1 | | 1 | 1 | | 1 | | | | | |
| 62 | | | 1 | 1 | 1 | | 1 | | | | | |
| 63 | 1 | | 1 | 1 | 1 | | 1 | | | | | |
| 64 | | 1 | 1 | 1 | 1 | | 1 | | | | | |
| 65 | 1 | 1 | 1 | 1 | 1 | | 1 | | | | | • |
| 66 | 1 | 1 | 1 | | | 1 | 1 | | | | | |
| 67 | | | | 1 | | 1 | 1 | | | | | |
| 68 | 1 | | | 1 | | 1 | 1 | | | | | |
| 69 | | 1 | | 1 | | 1 | 1 | | | | | |
| 70 | 1 | 1 | | 1 | | 1 | 1 | | | | | |
| 71 | | | 1 | 1 | | 1 | 1 | | | | | |
| 72 | 1 | | 1 | 1 | | 1 | 1 | | | | | |
| 73 | | 1 | 1 | 1 | | 1 | 1 | | | | | |
| 74 | 1 | 1 | 1 | 1 | | 1 | 1 | | | | | • |
| 75 | | | | | 1 | 1 | 1 | | | | | |
| 76 | 1 | | | | 1 | 1 | 1 | | | | | |
| 77 | | 1 | | | 1 | 1 | 1 | | | | | |
| 78 | 1 | 1 | | | 1 | 1 | 1 | | | | | |
| 79 | | | 1 | | 1 | 1 | 1 | | | | | |
| 80 | 1 | | 1 | | 1 | 1 | 1 | | | | | |
| 81 | | 1 | 1 | | 1 | 1 | 1 | | | | | |
| 82 | 1 | 1 | 1 | | 1 | 1 | 1 | | | | | • |
| 83 | | | | 1 | 1 | 1 | 1 | | | | | |

FIG. 2D

| Original gradation level | Subfield | | | | | | | | | | Display-use gradation level (a) | Display-use gradation level (b) |
|---|---|---|---|---|---|---|---|---|---|---|---|---|
| | 1 | 2 | 3 | 4 | 5 | 6 | 7 | 8 | 9 | 10 | | |
| | 1 | 2 | 4 | 8 | 16 | 25 | 34 | 44 | 55 | 66 | | |
| 84 | 1 | | | 1 | 1 | 1 | 1 | | | | | |
| 85 | | 1 | | 1 | 1 | 1 | 1 | | | | | |
| 86 | 1 | 1 | | 1 | 1 | 1 | 1 | | | | | • |
| 87 | | | 1 | 1 | 1 | 1 | 1 | | | | | |
| 88 | 1 | | 1 | 1 | 1 | 1 | 1 | | | | | • |
| 89 | | 1 | 1 | 1 | 1 | 1 | 1 | | | | | • |
| 90 | 1 | 1 | 1 | 1 | 1 | 1 | 1 | | | | • | • |
| 91 | | 1 | 1 | | 1 | 1 | | 1 | | | | |
| 92 | 1 | 1 | 1 | | 1 | 1 | | 1 | | | | |
| 93 | | | | 1 | 1 | 1 | | 1 | | | | |
| 94 | 1 | | | 1 | 1 | 1 | | 1 | | | | |
| 95 | | 1 | | 1 | 1 | 1 | | 1 | | | | |
| 96 | 1 | 1 | | 1 | 1 | 1 | | 1 | | | | |
| 97 | | | 1 | 1 | 1 | 1 | | 1 | | | | |
| 98 | 1 | | 1 | 1 | 1 | 1 | | 1 | | | | |
| 99 | | 1 | 1 | 1 | 1 | 1 | | 1 | | | | |
| 100 | 1 | 1 | 1 | 1 | 1 | 1 | | 1 | | | | • |
| 101 | 1 | 1 | 1 | | 1 | | 1 | 1 | | | | |
| 102 | | | | 1 | 1 | | 1 | 1 | | | | |
| 103 | 1 | | | 1 | 1 | | 1 | 1 | | | | |
| 104 | | 1 | | 1 | 1 | | 1 | 1 | | | | |
| 105 | 1 | 1 | | 1 | 1 | | 1 | 1 | | | | |
| 106 | | | 1 | 1 | 1 | | 1 | 1 | | | | |
| 107 | 1 | | 1 | 1 | 1 | | 1 | 1 | | | | |
| 108 | | 1 | 1 | 1 | 1 | | 1 | 1 | | | | |
| 109 | 1 | 1 | 1 | 1 | 1 | | 1 | 1 | | | | • |
| 110 | 1 | 1 | 1 | | | 1 | 1 | 1 | | | | |
| 111 | | | | 1 | | 1 | 1 | 1 | | | | |

FIG. 2E

| Original gradation level | Subfield | | | | | | | | | | Display-use gradation level (a) | Display-use gradation level (b) |
|---|---|---|---|---|---|---|---|---|---|---|---|---|
| | 1 | 2 | 3 | 4 | 5 | 6 | 7 | 8 | 9 | 10 | | |
| | 1 | 2 | 4 | 8 | 16 | 25 | 34 | 44 | 55 | 66 | | |
| 112 | 1 | | | 1 | | 1 | 1 | 1 | | | | |
| 113 | | 1 | | 1 | | 1 | 1 | 1 | | | | |
| 114 | 1 | 1 | | 1 | | 1 | 1 | 1 | | | | |
| 115 | | | 1 | 1 | | 1 | 1 | 1 | | | | |
| 116 | 1 | | 1 | 1 | | 1 | 1 | 1 | | | | |
| 117 | | 1 | 1 | 1 | | 1 | 1 | 1 | | | | |
| 118 | 1 | 1 | 1 | 1 | | 1 | 1 | 1 | | | | • |
| 119 | | | | | 1 | 1 | 1 | 1 | | | | |
| 120 | 1 | | | | 1 | 1 | 1 | 1 | | | | |
| 121 | | 1 | | | 1 | 1 | 1 | 1 | | | | |
| 122 | 1 | 1 | | | 1 | 1 | 1 | 1 | | | | |
| 123 | | | 1 | | 1 | 1 | 1 | 1 | | | | |
| 124 | 1 | | 1 | | 1 | 1 | 1 | 1 | | | | |
| 125 | | 1 | 1 | | 1 | 1 | 1 | 1 | | | | |
| 126 | 1 | 1 | 1 | | 1 | 1 | 1 | 1 | | | | • |
| 127 | | | | 1 | 1 | 1 | 1 | 1 | | | | |
| 128 | 1 | | | 1 | 1 | 1 | 1 | 1 | | | | |
| 129 | | 1 | | 1 | 1 | 1 | 1 | 1 | | | | |
| 130 | 1 | 1 | | 1 | 1 | 1 | 1 | 1 | | | | • |
| 131 | | | 1 | 1 | 1 | 1 | 1 | 1 | | | | |
| 132 | 1 | | 1 | 1 | 1 | 1 | 1 | 1 | | | | • |
| 133 | | 1 | 1 | 1 | 1 | 1 | 1 | 1 | | | | • |
| 134 | 1 | 1 | 1 | 1 | 1 | 1 | 1 | 1 | | | • | • |
| 135 | 1 | | 1 | | 1 | 1 | 1 | | 1 | | | |
| 136 | | 1 | 1 | | 1 | 1 | 1 | | 1 | | | |
| 137 | 1 | 1 | 1 | | 1 | 1 | 1 | | 1 | | | |
| 138 | | | | 1 | 1 | 1 | 1 | | 1 | | | |
| 139 | 1 | | | 1 | 1 | 1 | 1 | | 1 | | | |

FIG. 2F

| Original gradation level | Subfield | | | | | | | | | | Display-use gradation level (a) | Display-use gradation level (b) |
|---|---|---|---|---|---|---|---|---|---|---|---|---|
| | 1 | 2 | 3 | 4 | 5 | 6 | 7 | 8 | 9 | 10 | | |
| | 1 | 2 | 4 | 8 | 16 | 25 | 34 | 44 | 55 | 66 | | |
| 140 | | 1 | | 1 | 1 | 1 | 1 | | 1 | | | |
| 141 | 1 | 1 | | 1 | 1 | 1 | 1 | | 1 | | | |
| 142 | | | 1 | 1 | 1 | 1 | 1 | | 1 | | | |
| 143 | 1 | | 1 | 1 | 1 | 1 | 1 | | 1 | | | |
| 144 | | 1 | 1 | 1 | 1 | 1 | 1 | | 1 | | | |
| 145 | 1 | 1 | 1 | 1 | 1 | 1 | 1 | | 1 | | | • |
| 146 | | 1 | 1 | | 1 | 1 | | 1 | 1 | | | |
| 147 | 1 | 1 | 1 | | 1 | 1 | | 1 | 1 | | | |
| 148 | | | | 1 | 1 | 1 | | 1 | 1 | | | |
| 149 | 1 | | | 1 | 1 | 1 | | 1 | 1 | | | |
| 150 | | 1 | | 1 | 1 | 1 | | 1 | 1 | | | |
| 151 | 1 | 1 | | 1 | 1 | 1 | | 1 | 1 | | | |
| 152 | | | 1 | 1 | 1 | 1 | | 1 | 1 | | | |
| 153 | 1 | | 1 | 1 | 1 | 1 | | 1 | 1 | | | |
| 154 | | 1 | 1 | 1 | 1 | 1 | | 1 | 1 | | | |
| 155 | 1 | 1 | 1 | 1 | 1 | 1 | | 1 | 1 | | | • |
| 156 | 1 | 1 | 1 | | 1 | | 1 | 1 | 1 | | | |
| 157 | | | | 1 | 1 | | 1 | 1 | 1 | | | |
| 158 | 1 | | | 1 | 1 | | 1 | 1 | 1 | | | |
| 159 | | 1 | | 1 | 1 | | 1 | 1 | 1 | | | |
| 160 | 1 | 1 | | 1 | 1 | | 1 | 1 | 1 | | | |
| 161 | | | 1 | 1 | 1 | | 1 | 1 | 1 | | | |
| 162 | 1 | | 1 | 1 | 1 | | 1 | 1 | 1 | | | |
| 163 | | 1 | 1 | 1 | 1 | | 1 | 1 | 1 | | | |
| 164 | 1 | 1 | 1 | 1 | 1 | | 1 | 1 | 1 | | | • |
| 165 | 1 | 1 | 1 | | | 1 | 1 | 1 | 1 | | | |
| 166 | | | | 1 | | 1 | 1 | 1 | 1 | | | |
| 167 | 1 | | | 1 | | 1 | 1 | 1 | 1 | | | |

FIG. 2G

| Original gradation level | Subfield | | | | | | | | | | Display-use gradation level (a) | Display-use gradation level (b) |
|---|---|---|---|---|---|---|---|---|---|---|---|---|
| | 1 | 2 | 3 | 4 | 5 | 6 | 7 | 8 | 9 | 10 | | |
| | 1 | 2 | 4 | 8 | 16 | 25 | 34 | 44 | 55 | 66 | | |
| 168 | | 1 | | 1 | | 1 | 1 | 1 | 1 | | | |
| 169 | 1 | 1 | | 1 | | 1 | 1 | 1 | 1 | | | |
| 170 | | | 1 | 1 | | 1 | 1 | 1 | 1 | | | |
| 171 | 1 | | 1 | 1 | | 1 | 1 | 1 | 1 | | | |
| 172 | | 1 | 1 | 1 | | 1 | 1 | 1 | 1 | | | |
| 173 | 1 | 1 | 1 | 1 | | 1 | 1 | 1 | 1 | | | • |
| 174 | | | | | 1 | 1 | 1 | 1 | 1 | | | |
| 175 | 1 | | | | 1 | 1 | 1 | 1 | 1 | | | |
| 176 | | 1 | | | 1 | 1 | 1 | 1 | 1 | | | |
| 177 | 1 | 1 | | | 1 | 1 | 1 | 1 | 1 | | | |
| 178 | | | 1 | | 1 | 1 | 1 | 1 | 1 | | | |
| 179 | 1 | | 1 | | 1 | 1 | 1 | 1 | 1 | | | |
| 180 | | 1 | 1 | | 1 | 1 | 1 | 1 | 1 | | | |
| 181 | 1 | 1 | 1 | | 1 | 1 | 1 | 1 | 1 | | | • |
| 182 | | | | 1 | 1 | 1 | 1 | 1 | 1 | | | |
| 183 | 1 | | | 1 | 1 | 1 | 1 | 1 | 1 | | | |
| 184 | | 1 | | 1 | 1 | 1 | 1 | 1 | 1 | | | |
| 185 | 1 | 1 | | 1 | 1 | 1 | 1 | 1 | 1 | | | • |
| 186 | | | 1 | 1 | 1 | 1 | 1 | 1 | 1 | | | |
| 187 | 1 | | 1 | 1 | 1 | 1 | 1 | 1 | 1 | | | • |
| 188 | | 1 | 1 | 1 | 1 | 1 | 1 | 1 | 1 | | | • |
| 189 | 1 | 1 | 1 | 1 | 1 | 1 | 1 | 1 | 1 | | • | • |
| 190 | 1 | | 1 | | 1 | 1 | 1 | 1 | | 1 | | |
| 191 | | 1 | 1 | | 1 | 1 | 1 | 1 | | 1 | | |
| 192 | 1 | 1 | 1 | | 1 | 1 | 1 | 1 | | 1 | | |
| 193 | | | | 1 | 1 | 1 | 1 | 1 | | 1 | | |
| 194 | 1 | | | 1 | 1 | 1 | 1 | 1 | | 1 | | |
| 195 | | 1 | | 1 | 1 | 1 | 1 | 1 | | 1 | | |

FIG. 2H

| Original gradation level | Subfield | | | | | | | | | | Display-use gradation level (a) | Display-use gradation level (b)) |
|---|---|---|---|---|---|---|---|---|---|---|---|---|
| | 1 | 2 | 3 | 4 | 5 | 6 | 7 | 8 | 9 | 10 | | |
| | 1 | 2 | 4 | 8 | 16 | 25 | 34 | 44 | 55 | 66 | | |
| 196 | 1 | 1 | | 1 | 1 | 1 | 1 | 1 | | 1 | | |
| 197 | | | 1 | 1 | 1 | 1 | 1 | 1 | | 1 | | |
| 198 | 1 | | 1 | 1 | 1 | 1 | 1 | 1 | | 1 | | |
| 199 | | 1 | 1 | 1 | 1 | 1 | 1 | 1 | | 1 | | |
| 200 | 1 | 1 | 1 | 1 | 1 | 1 | 1 | 1 | | 1 | | • |
| 201 | 1 | | 1 | | 1 | 1 | 1 | | 1 | 1 | | |
| 202 | | 1 | 1 | | 1 | 1 | 1 | | 1 | 1 | | |
| 203 | 1 | 1 | 1 | | 1 | 1 | 1 | | 1 | 1 | | |
| 204 | | | | 1 | 1 | 1 | 1 | | 1 | 1 | | |
| 205 | 1 | | | 1 | 1 | 1 | 1 | | 1 | 1 | | |
| 206 | | 1 | | 1 | 1 | 1 | 1 | | 1 | 1 | | |
| 207 | 1 | 1 | | 1 | 1 | 1 | 1 | | 1 | 1 | | |
| 208 | | | 1 | 1 | 1 | 1 | 1 | | 1 | 1 | | |
| 209 | 1 | | 1 | 1 | 1 | 1 | 1 | | 1 | 1 | | |
| 210 | | 1 | 1 | 1 | 1 | 1 | 1 | | 1 | 1 | | |
| 211 | 1 | 1 | 1 | 1 | 1 | 1 | 1 | | 1 | 1 | | • |
| 212 | | 1 | 1 | | 1 | 1 | | 1 | 1 | 1 | | |
| 213 | 1 | 1 | 1 | | 1 | 1 | | 1 | 1 | 1 | | |
| 214 | | | | 1 | 1 | 1 | | 1 | 1 | 1 | | |
| 215 | 1 | | | 1 | 1 | 1 | | 1 | 1 | 1 | | |
| 216 | | 1 | | 1 | 1 | 1 | | 1 | 1 | 1 | | |
| 217 | 1 | 1 | | 1 | 1 | 1 | | 1 | 1 | 1 | | |
| 218 | | | 1 | 1 | 1 | 1 | | 1 | 1 | 1 | | |
| 219 | 1 | | 1 | 1 | 1 | 1 | | 1 | 1 | 1 | | |
| 220 | | 1 | 1 | 1 | 1 | 1 | | 1 | 1 | 1 | | |
| 221 | 1 | 1 | 1 | 1 | 1 | 1 | | 1 | 1 | 1 | | • |
| 222 | 1 | 1 | 1 | | 1 | | 1 | 1 | 1 | 1 | | |
| 223 | | | | | 1 | | 1 | 1 | 1 | 1 | | |

FIG. 2I

| Original gradation level | Subfield | | | | | | | | | | Display-use gradation level (a) | Display-use gradation level (b) |
|---|---|---|---|---|---|---|---|---|---|---|---|---|
| | 1 | 2 | 3 | 4 | 5 | 6 | 7 | 8 | 9 | 10 | | |
| | 1 | 2 | 4 | 8 | 16 | 25 | 34 | 44 | 55 | 66 | | |
| 224 | 1 | | | 1 | 1 | | 1 | 1 | 1 | 1 | | |
| 225 | | 1 | | 1 | 1 | | 1 | 1 | 1 | 1 | | |
| 226 | 1 | 1 | | 1 | 1 | | 1 | 1 | 1 | 1 | | |
| 227 | | | 1 | 1 | 1 | | 1 | 1 | 1 | 1 | | |
| 228 | 1 | | 1 | 1 | 1 | | 1 | 1 | 1 | 1 | | |
| 229 | | 1 | 1 | 1 | 1 | | 1 | 1 | 1 | 1 | | |
| 230 | 1 | 1 | 1 | 1 | 1 | | 1 | 1 | 1 | 1 | | • |
| 231 | 1 | 1 | 1 | | | 1 | 1 | 1 | 1 | 1 | | |
| 232 | | | | 1 | | 1 | 1 | 1 | 1 | 1 | | |
| 233 | 1 | | | 1 | | 1 | 1 | 1 | 1 | 1 | | |
| 234 | | 1 | | 1 | | 1 | 1 | 1 | 1 | 1 | | |
| 235 | 1 | 1 | | 1 | | 1 | 1 | 1 | 1 | 1 | | |
| 236 | | | 1 | 1 | | 1 | 1 | 1 | 1 | 1 | | |
| 237 | 1 | | 1 | 1 | | 1 | 1 | 1 | 1 | 1 | | |
| 238 | | 1 | 1 | 1 | | 1 | 1 | 1 | 1 | 1 | | |
| 239 | 1 | 1 | 1 | 1 | | 1 | 1 | 1 | 1 | 1 | | • |
| 240 | | | | | 1 | 1 | 1 | 1 | 1 | 1 | | |
| 241 | 1 | | | | 1 | 1 | 1 | 1 | 1 | 1 | | |
| 242 | | 1 | | | 1 | 1 | 1 | 1 | 1 | 1 | | |
| 243 | 1 | 1 | | | 1 | 1 | 1 | 1 | 1 | 1 | | |
| 244 | | | 1 | | 1 | 1 | 1 | 1 | 1 | 1 | | |
| 245 | 1 | | 1 | | 1 | 1 | 1 | 1 | 1 | 1 | | |
| 246 | | 1 | 1 | | 1 | 1 | 1 | 1 | 1 | 1 | | |
| 247 | 1 | 1 | 1 | | 1 | 1 | 1 | 1 | 1 | 1 | | • |
| 248 | | | | 1 | 1 | 1 | 1 | 1 | 1 | 1 | | |
| 249 | 1 | | | 1 | 1 | 1 | 1 | 1 | 1 | 1 | | |
| 250 | | 1 | | 1 | 1 | 1 | 1 | 1 | 1 | 1 | | |

FIG. 2J

| Original gradation level | Subfield | | | | | | | | | | Display-use gradation level (a) | Display-use gradation level (b) |
|---|---|---|---|---|---|---|---|---|---|---|---|---|
| | 1 | 2 | 3 | 4 | 5 | 6 | 7 | 8 | 9 | 10 | | |
| | 1 | 2 | 4 | 8 | 16 | 25 | 34 | 44 | 55 | 66 | | |
| 251 | 1 | 1 | | 1 | 1 | 1 | 1 | 1 | 1 | 1 | | • |
| 252 | | | 1 | 1 | 1 | 1 | 1 | 1 | 1 | 1 | | |
| 253 | 1 | | 1 | 1 | 1 | 1 | 1 | 1 | 1 | 1 | | • |
| 254 | | 1 | 1 | 1 | 1 | 1 | 1 | 1 | 1 | 1 | | • |
| 255 | 1 | 1 | 1 | 1 | 1 | 1 | 1 | 1 | 1 | 1 | • | • |

FIG. 6A

| | |
|---|---|
| d1 | d3 |
| d4 | d2 |

FIG. 6B

| | | | | | | | | | |
|---|---|---|---|---|---|---|---|---|---|
| d1 | d3 | d1 | d3 | d1 | d3 | d1 | d3 | d1 | d3 |
| d4 | d2 | d4 | d2 | d4 | d2 | d4 | d2 | d4 | d2 |
| d1 | d3 | d1 | d3 | d1 | d3 | d1 | d3 | d1 | d3 |
| d4 | d2 | d4 | d2 | d4 | d2 | d4 | d2 | d4 | d2 |
| d1 | d3 | d1 | d3 | d1 | d3 | d1 | d3 | d1 | d3 |
| d4 | d2 | d4 | d2 | d4 | d2 | d4 | d2 | d4 | d2 |
| d1 | d3 | d1 | d3 | d1 | d3 | d1 | d3 | d1 | d3 |
| d4 | d2 | d4 | d2 | d4 | d2 | d4 | d2 | d4 | d2 |

FIG. 6C

| | |
|---|---|
| d3 | d1 |
| d2 | d4 |

FIG. 6D

| | | | | | | | | | |
|---|---|---|---|---|---|---|---|---|---|
| d3 | d1 | d3 | d1 | d3 | d1 | d3 | d1 | d3 | d1 |
| d2 | d4 | d2 | d4 | d2 | d4 | d2 | d4 | d2 | d4 |
| d3 | d1 | d3 | d1 | d3 | d1 | d3 | d1 | d3 | d1 |
| d2 | d4 | d2 | d4 | d2 | d4 | d2 | d4 | d2 | d4 |
| d3 | d1 | d3 | d1 | d3 | d1 | d3 | d1 | d3 | d1 |
| d2 | d4 | d2 | d4 | d2 | d4 | d2 | d4 | d2 | d4 |
| d3 | d1 | d3 | d1 | d3 | d1 | d3 | d1 | d3 | d1 |
| d2 | d4 | d2 | d4 | d2 | d4 | d2 | d4 | d2 | d4 |

FIG. 9

| Grad-ation level | Subfield | | | | | | | | | | Agitation constant | | | |
|---|---|---|---|---|---|---|---|---|---|---|---|---|---|---|
| | 1 | 2 | 3 | 4 | 5 | 6 | 7 | 8 | 9 | 10 | | | | |
| | 1 | 2 | 4 | 8 | 16 | 25 | 34 | 44 | 55 | 66 | d1 | d2 | d3 | d4 |
| 0 | | | | | | | | | | | 0 | 0 | 0 | 0 |
| 1 | 1 | | | | | | | | | | 0 | 0 | 0 | 0 |
| 2 | | 1 | | | | | | | | | 0 | 0 | 0 | 0 |
| 188 | | 1 | 1 | 1 | 1 | 1 | 1 | 1 | 1 | | -38 | -19 | 19 | 38 |
| 189 | 1 | 1 | 1 | 1 | 1 | 1 | 1 | 1 | 1 | | -38 | -19 | 19 | 38 |
| 190 | 1 | | 1 | | 1 | 1 | 1 | 1 | | 1 | -38 | -19 | 19 | 38 |
| 191 | | 1 | 1 | | 1 | 1 | 1 | 1 | | 1 | -38 | -19 | 19 | 38 |
| 192 | 1 | 1 | 1 | | 1 | 1 | 1 | 1 | | 1 | -38 | -19 | 19 | 38 |
| 193 | | | | 1 | 1 | 1 | 1 | 1 | | 1 | -39 | -19 | 19 | 39 |
| 194 | 1 | | | 1 | 1 | 1 | 1 | 1 | | 1 | -39 | -19 | 19 | 39 |
| 195 | | 1 | | 1 | 1 | 1 | 1 | 1 | | 1 | -39 | -20 | 20 | 39 |
| 196 | 1 | 1 | | 1 | 1 | 1 | 1 | 1 | | 1 | -39 | -20 | 20 | 39 |
| 197 | | | 1 | 1 | 1 | 1 | 1 | 1 | | 1 | -39 | -20 | 20 | 39 |
| 198 | 1 | | 1 | 1 | 1 | 1 | 1 | 1 | | 1 | -40 | -20 | 20 | 40 |
| 199 | | 1 | 1 | 1 | 1 | 1 | 1 | 1 | | 1 | -40 | -20 | 20 | 40 |
| 200 | 1 | 1 | 1 | 1 | 1 | 1 | 1 | 1 | | 1 | -40 | -20 | 20 | 40 |
| 201 | 1 | | 1 | | 1 | 1 | 1 | | 1 | 1 | -40 | -20 | 20 | 40 |
| 202 | | 1 | 1 | | 1 | 1 | 1 | | 1 | 1 | -40 | -20 | 20 | 40 |
| 203 | 1 | 1 | 1 | | 1 | 1 | 1 | | 1 | 1 | -41 | -20 | 20 | 41 |
| 204 | | | | 1 | 1 | 1 | 1 | | 1 | 1 | -41 | -20 | 20 | 41 |
| 205 | 1 | | | 1 | 1 | 1 | 1 | | 1 | 1 | -41 | -21 | 21 | 41 |
| 206 | | 1 | | 1 | 1 | 1 | 1 | | 1 | 1 | -41 | -21 | 21 | 41 |
| 207 | 1 | 1 | | 1 | 1 | 1 | 1 | | 1 | 1 | -41 | -21 | 21 | 41 |
| 208 | | | 1 | 1 | 1 | 1 | 1 | | 1 | 1 | -42 | -21 | 21 | 42 |
| 209 | 1 | | 1 | 1 | 1 | 1 | 1 | | 1 | 1 | -42 | -21 | 21 | 42 |
| 210 | | 1 | 1 | 1 | 1 | 1 | 1 | | 1 | 1 | -42 | -21 | 21 | 42 |
| 211 | 1 | 1 | 1 | 1 | 1 | 1 | 1 | | 1 | 1 | -42 | -21 | 21 | 42 |
| 212 | | 1 | 1 | | 1 | 1 | | 1 | 1 | 1 | -42 | -21 | 21 | 42 |

FIG. 11A

| Limited gradation level | Subfield | | | | | | | | | | Agitation constant | | | |
|---|---|---|---|---|---|---|---|---|---|---|---|---|---|---|
| | 1 | 2 | 3 | 4 | 5 | 6 | 7 | 8 | 9 | 10 | | | | |
| | 1 | 2 | 4 | 8 | 16 | 25 | 34 | 44 | 55 | 66 | d1 | d2 | d3 | d4 |
| 0 | | | | | | | | | | | 0 | 0 | 0 | 0 |
| 1 | 1 | | | | | | | | | | -1 | 0 | 0 | 1 |
| 2 | | 1 | | | | | | | | | -1 | 0 | 0 | 1 |
| 3 | 1 | 1 | | | | | | | | | -2 | -1 | 1 | 2 |
| 4 | | | 1 | | | | | | | | -2 | -1 | 1 | 2 |
| 5 | 1 | | 1 | | | | | | | | -2 | -1 | 1 | 2 |
| 6 | | 1 | 1 | | | | | | | | -3 | -1 | 1 | 3 |
| 7 | 1 | 1 | 1 | | | | | | | | -4 | -2 | 2 | 4 |
| 9 | 1 | | | 1 | | | | | | | -4 | -2 | 2 | 4 |
| 11 | 1 | 1 | | 1 | | | | | | | -4 | -2 | 2 | 4 |
| 13 | 1 | | 1 | 1 | | | | | | | -6 | -2 | 2 | 6 |
| 15 | 1 | 1 | 1 | 1 | | | | | | | -8 | -4 | 4 | 8 |
| 19 | 1 | 1 | | | 1 | | | | | | -8 | -4 | 4 | 8 |
| 23 | 1 | 1 | 1 | | 1 | | | | | | -8 | -4 | 4 | 8 |
| 27 | 1 | 1 | | 1 | 1 | | | | | | -10 | -4 | 4 | 10 |
| 31 | 1 | 1 | 1 | 1 | 1 | | | | | | -13 | -6 | 6 | 13 |
| 37 | | | 1 | 1 | | 1 | | | | | -13 | -7 | 7 | 13 |
| 44 | 1 | 1 | | | 1 | 1 | | | | | -12 | -6 | 6 | 12 |
| 50 | 1 | | | 1 | 1 | 1 | | | | | -15 | -6 | 6 | 15 |
| 56 | 1 | 1 | 1 | 1 | 1 | 1 | | | | | -17 | -9 | 9 | 17 |
| 65 | 1 | 1 | 1 | 1 | 1 | | 1 | | | | -17 | -8 | 8 | 17 |
| 73 | | 1 | 1 | 1 | | 1 | 1 | | | | -17 | -9 | 9 | 17 |
| 82 | 1 | 1 | 1 | | 1 | 1 | 1 | | | | -19 | -8 | 8 | 19 |
| 90 | 1 | 1 | 1 | 1 | 1 | 1 | 1 | | | | -22 | -11 | 11 | 22 |

FIG. 11B

| Limited gradation level | Subfield | | | | | | | | | | Agitation constant | | | |
|---|---|---|---|---|---|---|---|---|---|---|---|---|---|---|
| | 1 | 2 | 3 | 4 | 5 | 6 | 7 | 8 | 9 | 10 | | | | |
| | 1 | 2 | 4 | 8 | 16 | 25 | 34 | 44 | 55 | 66 | d1 | d2 | d3 | d4 |
| 101 | 1 | 1 | 1 | | 1 | | 1 | 1 | | | -22 | -11 | 11 | 22 |
| 112 | | | | 1 | | 1 | 1 | 1 | | | -22 | -11 | 11 | 22 |
| 123 | | | 1 | | 1 | 1 | 1 | 1 | | | -25 | -11 | 11 | 25 |
| 134 | 1 | 1 | 1 | 1 | 1 | 1 | 1 | 1 | | | -28 | -14 | 14 | 28 |
| 148 | | | | 1 | 1 | 1 | | 1 | 1 | | -27 | -14 | 14 | 27 |
| 162 | 1 | | 1 | 1 | 1 | | 1 | 1 | 1 | | -27 | -13 | 13 | 27 |
| 175 | 1 | | | | 1 | 1 | 1 | 1 | 1 | | -31 | -14 | 14 | 31 |
| 189 | 1 | 1 | 1 | 1 | 1 | 1 | 1 | 1 | 1 | | -33 | -17 | 17 | 33 |
| 206 | | 1 | | 1 | 1 | 1 | 1 | | 1 | 1 | -33 | -16 | 16 | 33 |
| 222 | 1 | 1 | 1 | | 1 | | 1 | 1 | 1 | 1 | -33 | -17 | 17 | 33 |
| 239 | 1 | 1 | 1 | 1 | | 1 | 1 | 1 | 1 | 1 | -17 | -17 | 17 | 17 |
| 255 | 1 | 1 | 1 | 1 | 1 | 1 | 1 | 1 | 1 | 1 | 0 | 0 | 0 | 0 |

IMAGE DISPLAY APPARATUS FOR CORRECTING DYNAMIC FALSE CONTOURS

This application is a U.S. National Phase Application of Pct International Application PCT/JP03/017017.

TECHNICAL FIELD

The present invention relates to an image display apparatus such as a plasma display panel (PDP) or a digital mirror device (DMD), which displays a multilevel gradation by dividing a single image field into a plurality of subfields.

BACKGROUND ART

An image display apparatus such as a PDP or a DMD, that performs a binary control of light emission and non-emission, typically uses a subfield method for intermediate gradation display. The subfield method uses a plurality of subfields weighted with the number of light emission or the amount of light emission to divide a single field by temporal decomposition, thereby performing a binary control of each pixel for each subfield. In other words, each subfield has its predetermined luminance weight, and the sum of the weights for emitting subfields determines the gradation level.

FIG. 12 shows an example configuration of a subfield in a conventional PDP. In this configuration, a single field is divided into eight subfields (SF1, SF2, . . . , and SF8), where respective subfields have luminance weights (1, 2, 4, 8, 16, 32, 64, and 128). Each subfield is composed of setup period T1 for preliminary discharge, address period T2 during which data for light emission or non-emission is written for each pixel, and sustain period T3 during which pixels with light-emitting data being written are made to emit light all at once. Combining these subfields in various ways for emitting light can produces 256 level gradation of "0" level through "255" level. For example, gradation level "7" is presented by emitting SF1, SF2, and SF3 having luminance weights 1, 2, and 4, respectively, and gradation level "21" is presented by emitting SF1, SF3, SF5 having luminance weights 1, 4, and 16, respectively.

In such a display apparatus that uses the subfield method for displaying multilevel gradation, it is known that false contours (dynamic false contours) appear and deteriorate the image quality while motion pictures are displayed. The dynamic false contours are described hereinafter. In the same way as the above, a single field is assumed to be divided into eight subfields (SF1 through SF8) respectively weighted with (1, 2, 4, 8, 16, 32, 64 and 128). AS shown in FIG. 13, a case is described where image pattern X moves on the screen of PDP 33 horizontally. Image pattern X has region P1 with gradation level "127" and region P2 with gradation level "128." FIG. 14 is a view in which image pattern X is developed to subfields, where a horizontal axis corresponds to a horizontal direction on the screen of PDP 33, and a vertical axis corresponds to a time direction. In addition, hatched areas in FIG. 14 show non-emitting subfields.

When image pattern X remains stationary, as shown in FIG. 14, a viewer's viewpoint is also fixed to screen position A, and thus gradation levels "127" and "128," which are pixel-original gradation, are perceived. However, when image pattern X moves to the left, the viewpoint also moves to the direction of screen position B-B', and thus the non-emitting subfields in region P2 and region P1 are viewed. Consequently, gradation level "0", i.e., a dark line, is perceived. Reversely, when image pattern X moves to the right, the viewpoint also moves in the direction of screen position C-C', and thus light-emitting subfields in region P1 and region P2 are seen, where gradation level "255," i.e., a bright line, is perceived. In either case, the gradation levels are largely different from the original gradation level "127" or "128", and thus are perceived as contours. In this way, false contours, in spite of their small change in gradation levels, occur where the pattern of light-emitting subfields largely changes. For example, if subfields weighted as above-mentioned are used, also in cases where the luminance gradation levels of the adjacent pixels are "63" and "64," "191" and "192," or the like, false contours are prominently observed. Such a phenomenon is called a false contour noise, causing image quality to deteriorate.

Conventional methods for suppressing dynamic false contours include the following.

For example, convert the gradation level of an image signal to a "first gradation level" where dynamic false contours are unlikely to occur, and to its "intermediate gradation level," and then diffuse an error caused by the conversion to the surrounding pixels to interpolate the skipping of gradation levels. Next, if the converted gradation level is "intermediate gradation level," round up or round down to the nearest "first gradation level." Repeat rounding-up and rounding-down alternately by dot, by line, and by field to present averagely "intermediate gradation levels."

However, such a method has the following problems. Namely, the number of gradation levels inevitably decreases near a gradation level at which large dynamic false contours occur. In other words, suppressing dynamic false contours decreases the number of gradation levels, causing a visually rough image, while securing a desired number causes dynamic false contours to occur.

SUMMERY OF THE INVENTION

The present invention is directed to an image display apparatus including: an agitation constant generator for generating a plurality of agitation constants for a gradation level corresponding to an image signal; an agitation constant selector for selecting one agitation constant out of a plurality of constants; and an agitation adder having an adder for adding the agitation constant to an image signal.

BRIEF DESCRIPTION OF THE DRAWINGS

FIG. 2A shows a configuration of subfields and display-use gradation levels (0 through 27) used in the image display apparatus according to embodiments 1 and 2 of the present invention.

FIG. 2B shows a configuration of subfields and display-use gradation levels (28 through 55) used in the image display apparatus according to embodiments 1 and 2 of the present invention.

FIG. 2C shows a configuration of subfields and display-use gradation levels (56 through 83) used in the image display apparatus according to embodiments 1 and 2 of the present invention.

FIG. 2D shows a configuration of subfields and display-use gradation levels (84 through 111) used in the image display apparatus according to embodiments 1 and 2 of the present invention.

FIG. 2E shows a configuration of subfields and display-use gradation levels (112 through 139) used in the image display apparatus according to embodiments 1 and 2 of the present invention.

FIG. 2F shows a configuration of subfields and display-use gradation levels (140 through 167) used in the image display apparatus according to embodiments 1 and 2 of the present invention.

FIG. 2G shows a configuration of subfields and display-use gradation levels (168 through 195) used in the image display apparatus according to embodiments 1 and 2 of the present invention.

FIG. 2H shows a configuration of subfields and display-use gradation levels (196 through 223) used in the image display apparatus according to embodiments 1 and 2 of the present invention.

FIG. 2I shows a configuration of subfields and display-use gradation levels (224 through 250) used in the image display apparatus according to embodiments 1 and 2 of the present invention.

FIG. 2J shows a configuration of subfields and display-use gradation levels (251 through 255) used in the image display apparatus according to embodiments 1 and 2 of the present invention.

FIGS. 6A, 6B, 6C, and 6D illustrate operations of an agitation constant adder for the image display apparatus according to embodiments 1 and 2 of the present invention.

FIG. 9 shows agitation constants corresponding to respective gradation levels used in embodiment 1 of the present invention.

FIGS. 11A and 11B show gradation levels limited by a second gradation-level limiter used in embodiment 2 of the present invention, and agitation constants corresponding to the gradation levels limited.

DETAILED DESCRIPTION OF PREFERRED EMBODIMENTS

Embodiment

Embodiment 1

Figure 1:
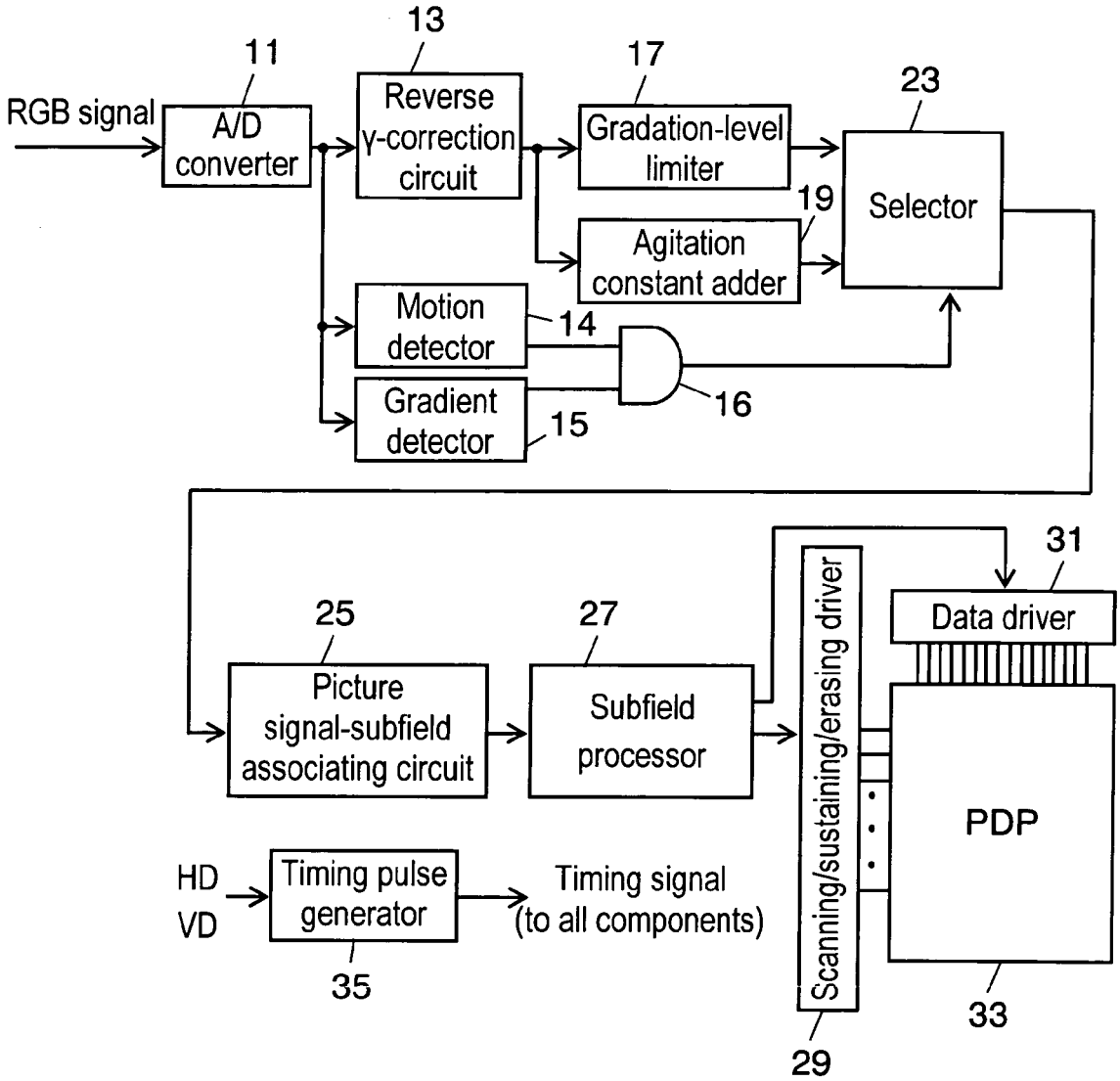
FIG. 1 is a circuit block diagram of an image display apparatus according to embodiment 1 of the present invention.

In FIG. 1, A/D converter 11 converts RGB signals (image signals) from analog to digital. Inverse gamma correction circuit 13 performs inverse gamma correction for the converted image signal. Motion detector 14 detects if the image is a motion picture or not, according to the difference in image signal between fields for example. Gradient detector 15 detects a continuous part where the gradation has some level of gradient in the screen, and also such a condition extends over pixels with a level recognizable (hereafter abbreviated as "gradient gradation-level regions"), according to the difference in image signal between adjacent pixels for example. AND circuit 16 detects a moving gradient gradation-level region by an AND operation of the outputs from motion detector 14 and gradient detector 15. The inverse-gamma-corrected image signal is sent to gradation-level limiter 17, and also to agitation constant adder 19 for adding an agitation constant. Gradation-level limiter 17 converts the gradation level of the image signal having been sent, to one where dynamic false contours do not occur, and also increases the number of gradation levels in a pseudo manner according to an error diffusion process. For gradation-level limiter 17 and agitation constant adder 19, a detail description is made later because they represent a principle part of the present invention. Selector 23, based on the output from AND circuit 16, selects the output from agitation constant adder 19 for a moving gradient gradation-level region, and selects the output from gradation-level limiter 17 for the other images. This action is to enable the process of agitation constant adder 19 only for a moving gradient gradation-level region. Image signal-subfield associating circuit 25 converts an image signal selected by selector 23 to field information composed of a plurality of bits indicating whether a subfield is light-emitting or not. Subfield processor 27 determines the number of sustain pulses generated during their sustain period based on the field information. Scanning-sustaining-erasing driver 29 and data driver 31, based on the output from subfield processor 27, controls the amount of light emission for each pixel to display an image with a desired gradation level on PDP 33. Timing pulse generator 35, based on horizontal synchronizing signals and vertical synchronizing signals, generates various kinds of timing signals and supplies them to all components in the display apparatus.

Next, a description is made for a gradation level where false contours do not occur, used in embodiment 1. In embodiment 1, as shown in FIGS. 2A through 2J, a single field is assumed to be divided into ten subfields (SF1, SF2, . . . , and SF10), where respective subfields have luminance weights (1, 2, 4, 8, 16, 25, 34, 44, 55 and 66) respectively. In FIGS. 2A through 2J, "1" in the column of each subfield indicates that the corresponding subfield is to emit.

As described above, a position where dynamic false contours tend to occur is, between adjacent pixels, where the pattern of an emitting subfield changes largely in spite of its small change in gradation level. For example, the gradation levels of adjacent pixels are "15" and "16". In this case, referring to the columns for subfields in FIGS. 2A through 2J, set 1 to an emitting subfield and 0 to non-emitting subfield, and then arrange SF1 through SF10 sequentially. As the result, gradation level "15" becomes 1111000000, and gradation level "16," becomes 0000100000, where the change of the pattern is found to be large for an emitting subfield.

Therefore, as a gradation level at which false contours do not occur, the next condition can be considered.

Condition (a): a gradation level at which all the subfields having a weight smaller than that of an emitting subfield emit light The gradation levels satisfying this condition are specifically eleven gradation levels (0, 1, 3, 7, 15, 31, 56, 90, 134, 189 and 255). These gradation levels are indicated with a solid dot "•" in a column of "display-use gradation level a" in FIGS. 2A through 2J. For example, gradation level "31"

satisfies condition (a) because all the subfields having a weight of SF5 or less emit light; a weight of SF6 or greater, do not emit light. For these gradations, as the gradation level increases, the number of emitting subfields increases monotonously. Consequently, if pixels with a similar gradation level in the display-use gradation level are adjacent each other, the distribution of emitting and non-emitting subfields shows no change, and thus dynamic false contours do not occur.

However, when the number of display-use gradation levels is thus limited, only eleven gradation levels are available for displaying an image as mentioned above, largely reducing the level of gradation expressiveness. Therefore, this condition is a little relaxed in embodiment 1. That is, Condition (b): A gradation level that is 0 or 1 for a non-emitting subfield out of all the subfields having a weight smaller than that of an emitting subfield.

These gradation levels are indicated with a solid dot "•" in a column of "display-use gradation level b" in FIGS. 2A through 2J. The number of gradation levels satisfying condition (b), in addition to those of condition (a), totals 56 where (2, 5, 6, 11, 13, 14, . . . , 251, 253, and 254) are added, which are far greater than those of condition (a). Accordingly, a more smooth gradation can be presented. Further, the gradation satisfying condition (b), between adjacent pixels, does not result in a large change in distribution of emitting and non-emitting subfields, and thus can be used as a gradation in which false contours unlikely appear.

Figure 3:
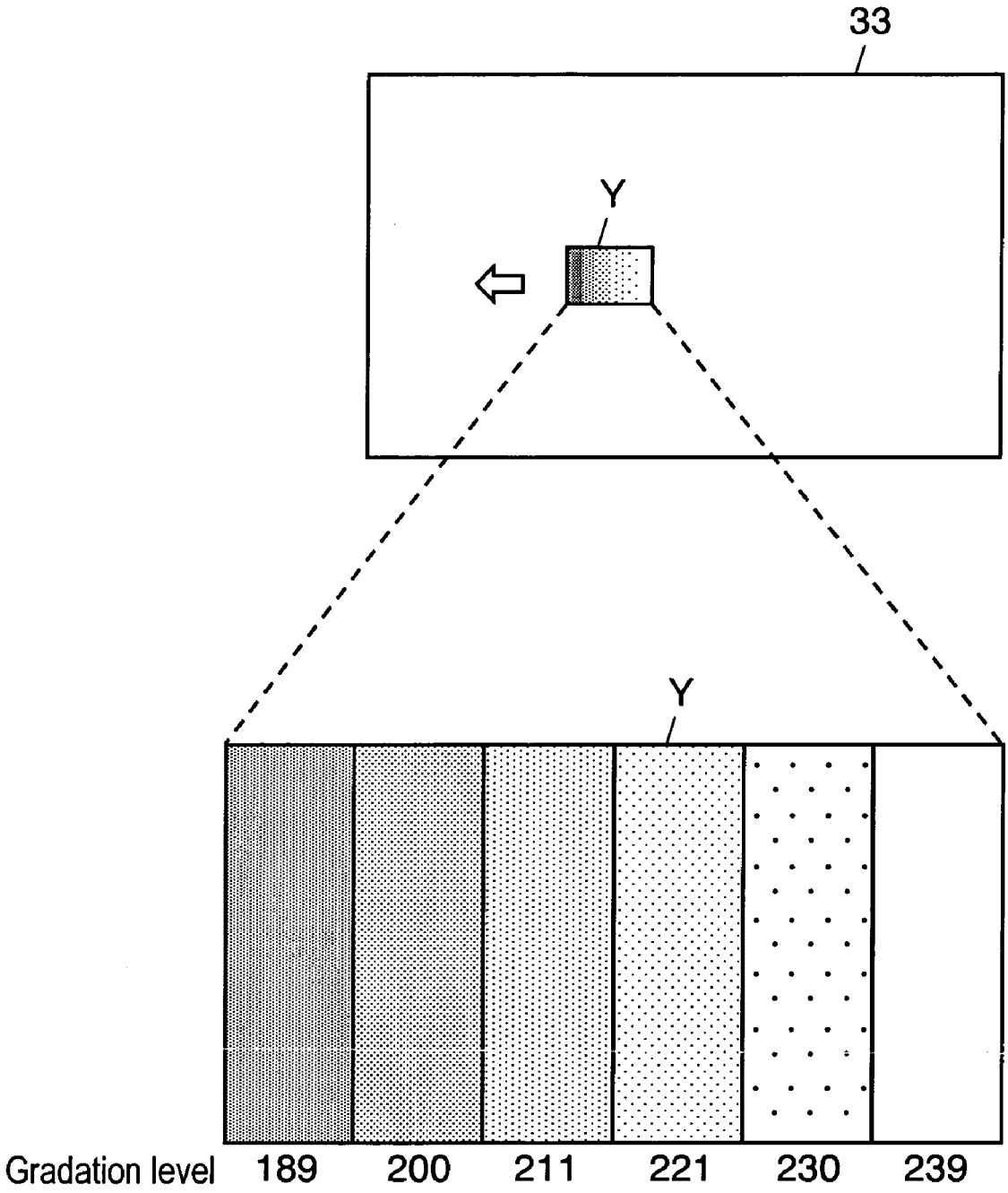
FIG. 3 illustrates a display pattern when dynamic false contours occur.
Figure 4:
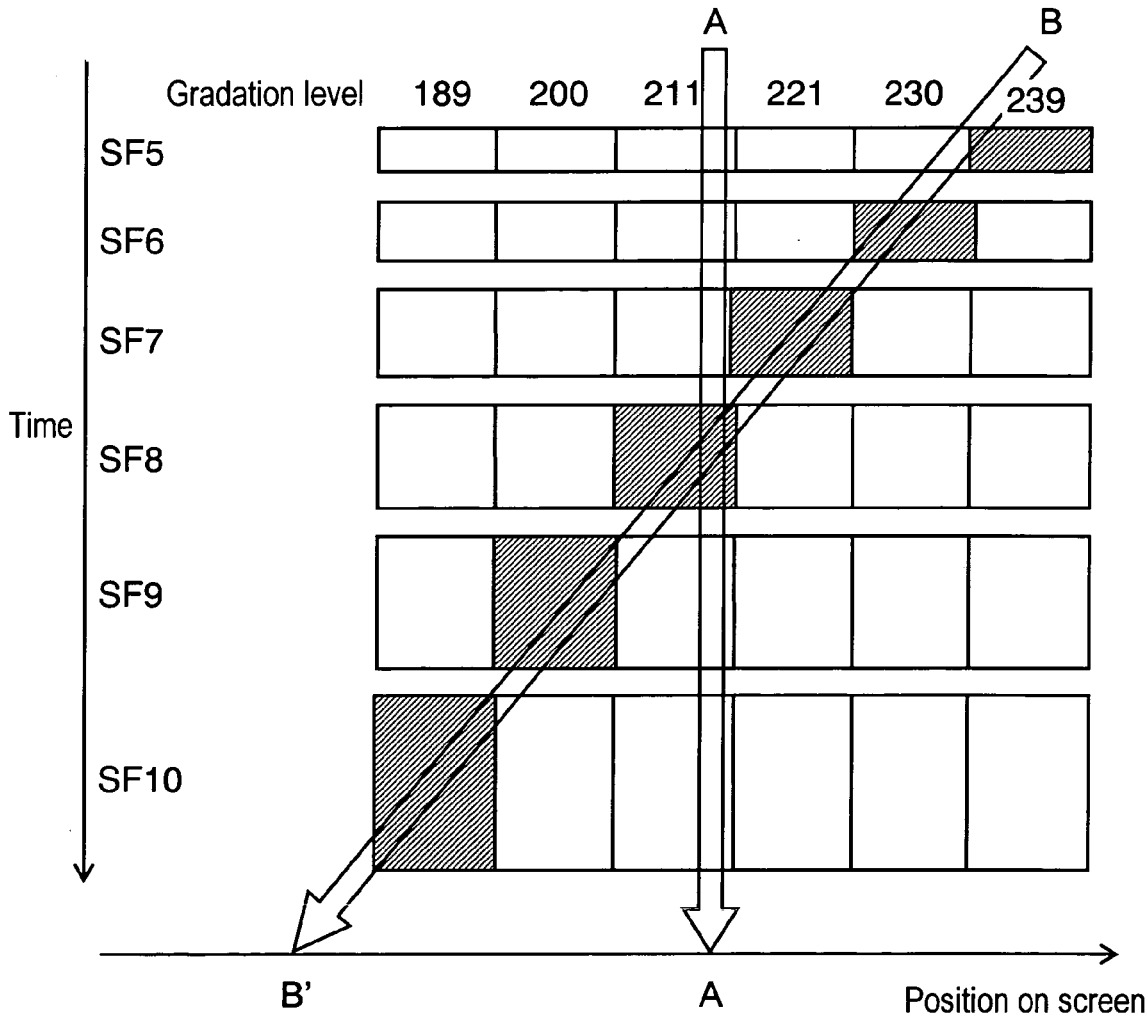
FIG. 4 illustrates a cause for which dynamic false contours occur.

When this gradation is used as a display-use gradation, however, for the following image region with a particular pattern, larger dynamic false contours may be observed. For example, as shown in FIG. 3, a description is made for a case where a gradation has some level of gradient and pattern Y with some extent of area size moves. For example, Y is supposed to be expressed by six regions with gradation levels "189", "200", "211", "221", "230" and "239," using a gradation satisfying condition (b). FIG. 4 is a view in which image pattern Y is developed to subfields, where the lateral direction corresponds to the horizontal direction on the screen of PDP 33, and the vertical direction corresponds to the elapse of the time. In addition, the hatched areas in FIG. 4 show non-emitting subfields. When the image pattern remains stationary, a viewer's viewpoint is also fixed to screen position A, and thus the original gradation is perceived. However, when image pattern Y moves to the left, the viewpoint also moves to the direction of screen position B-B', and thus this action ends up following intermediate non-emitting subfields in the six regions. Consequently, very dark lines compared with the original image are perceived.

In this way, in a case where a gradation has some level of gradient in the screen, and also such a condition extends over pixels with a level recognizable, namely a gradient gradation region moves at a speed visually traceable, very large dynamic false contours are perceived. Therefore, in the image display apparatus according to embodiment 1, different image processes are made for a gradient gradation-level region and the other regions (non-gradient gradation-level regions).

First, a description is made for the process for a non-gradient gradation-level region. The same process as a non-gradient gradation-level region is to be made for a stationary gradient gradation-level region.

For a non-gradient gradation-level region, a gradation satisfying the next condition is used as its display-use gradation, as mentioned above.

Condition (b): A gradation level that is 0 or 1 for a non-emitting subfield out of all the subfields having a weight smaller than that of an emitting subfield.

Figure 5A:
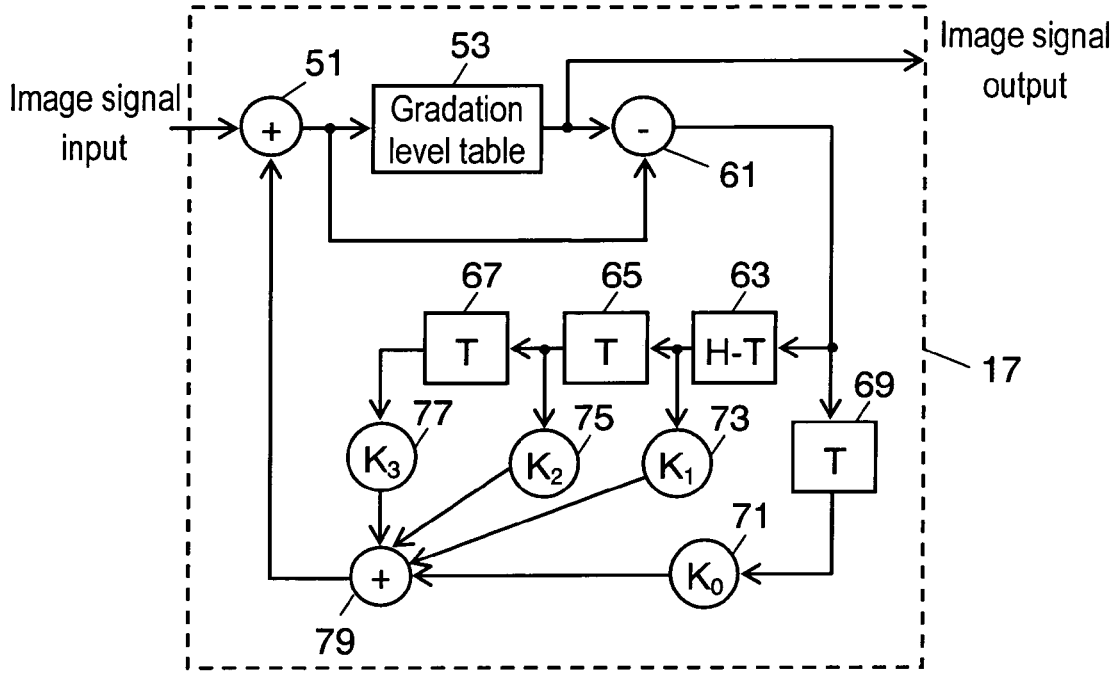
FIG. 5A is a circuit block diagram of a gradation-level limiter for the image display apparatus according to embodiments 1 and 2 of the present invention.
Figure 5B:
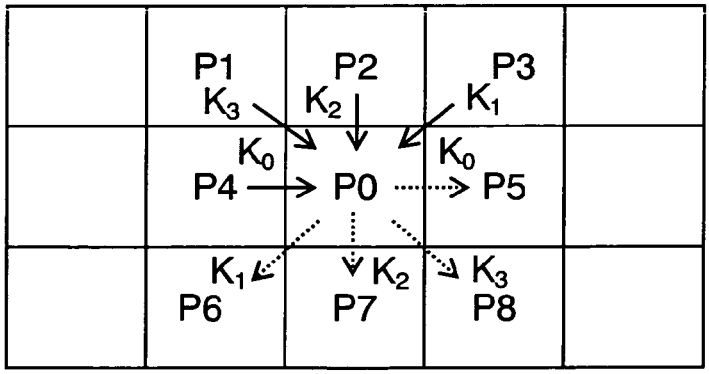
FIG. 5B illustrates operations of the gradation-level limiter for the image display apparatus according to embodiments 1 and 2 of the present invention.

FIG. 5A is a circuit block diagram of gradation-level limiter 17 according to embodiment 1. Gradation-level limiter 17, using gradation level limiting table 53, limits an image signal output to a gradation level satisfying condition (b), and also performs an error diffusion process with the difference between the input image signal and the gradation level-limited signal as a display error. Blocks 65, 67 and 69 marked "T" in FIG. 5A indicate one-pixel delay circuits, and block 63 marked "H-T" indicates a one-line-minus-one-pixel delay circuit. As shown in FIG. 5B, a single pixel P0 is being focused and the corresponding image signal has been input. In this case, multiply respective display errors in pixels P1, P2 and P3, all are one line prior to pixel P0, and pixel P4, immediately preceding, by weight coefficients k3, k2, k1 and k0, using multipliers 77, 75, 73 and 71. Next add them to the input signal for pixel P0 using adders 79 and 51. Then compare the sum of the signal values with the values in gradation level limiting table 53, and output the value nearest to the sum signal value as an image signal. Along with this operation, calculate the difference between the above-mentioned sum signal value and one having been output, using subtracter 61. Then, with the result as a display error, multiply pixel P5, next to pixel P0, and pixels P6, P7 and P8, all are one line after, by weight coefficients k0, k1, k2, and k3, respectively, and then diffuse them. Where, respective weight coefficients are set to such values that equation k0+k1+k2+k3=1 holds.

Applying this error diffusion process all over the screen retains an enough number of gradation levels to be displayed, in which the whole screen is viewed as if the original luminance is presented. Accordingly, a smooth image, without roughness can be achieved.

Next, a description is made for a process method in a gradient gradation-level region.

For a moving gradient gradation-level region, as described above, a method to limit to a gradation satisfying condition (b) can not be used. Instead, even if dynamic false contours occur, prevent its portion from being visually perceived by dispersing the portion in the gradient gradation-level region. In other words, superimpose a predetermined agitation on respective image signals, and consequently perform a process to disperse a portion where dynamic false contours have occurred. This process is performed in the following procedures. First, as shown in FIG. 6A, suppose there is a virtual matrix with two pixels by two lines, and pave all over the screen with the matrices (FIG. 6B). Meanwhile, prepare four agitation constants d1 through d4 for each gradation level. After that, select agitation constants specified by a corresponding matrix for each pixel to add to the image signal. The image display apparatus according to embodiment 1 has two kinds of above-mentioned matrices, which are used selectively by field.

Figure 7:
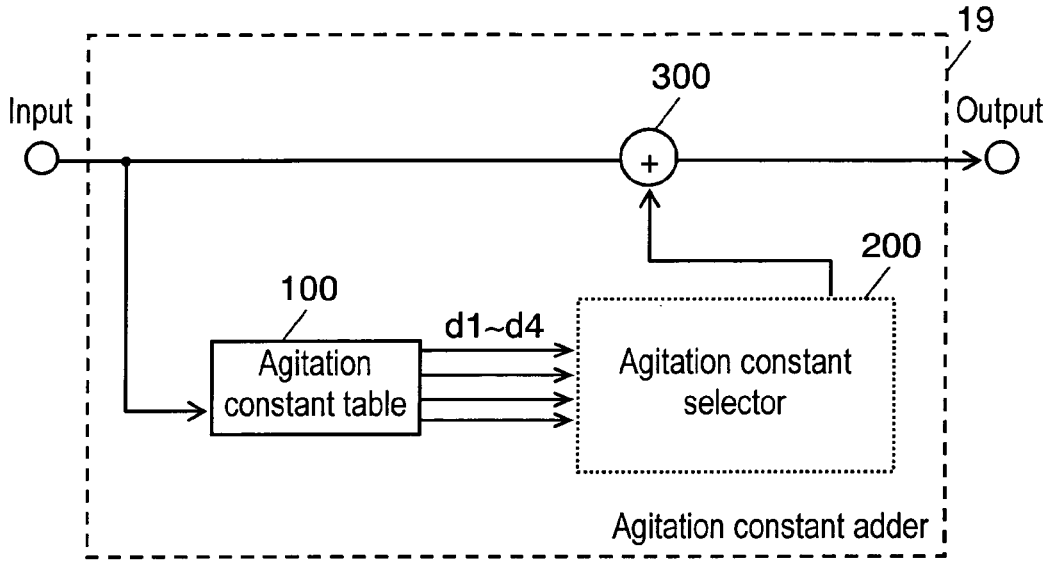
FIG. 7 is a circuit diagram of the agitation constant adder for the image display apparatus according to embodiments 1 and 2 of the present invention.

FIG. 7 is a circuit diagram of agitation constant adder 19 for performing these processes according to embodiment 1. Agitation constant adder 19 is formed of: agitation constant table 100 for generating agitation constants, agitation constant selector 200 for selecting an agitation constant, and adder 300 for adding. Agitation constant table 100 generates agitation constants d1 through d4 each corresponding to a gradation level of an image signal having being input. Agitation constant selector 200 selects one agitation constant out of four agitation constants d1 through d4 corresponding to a matrix, and outputs to adder 300. Adder 300 adds a selected agitation constant to an image signal.

Figure 8:
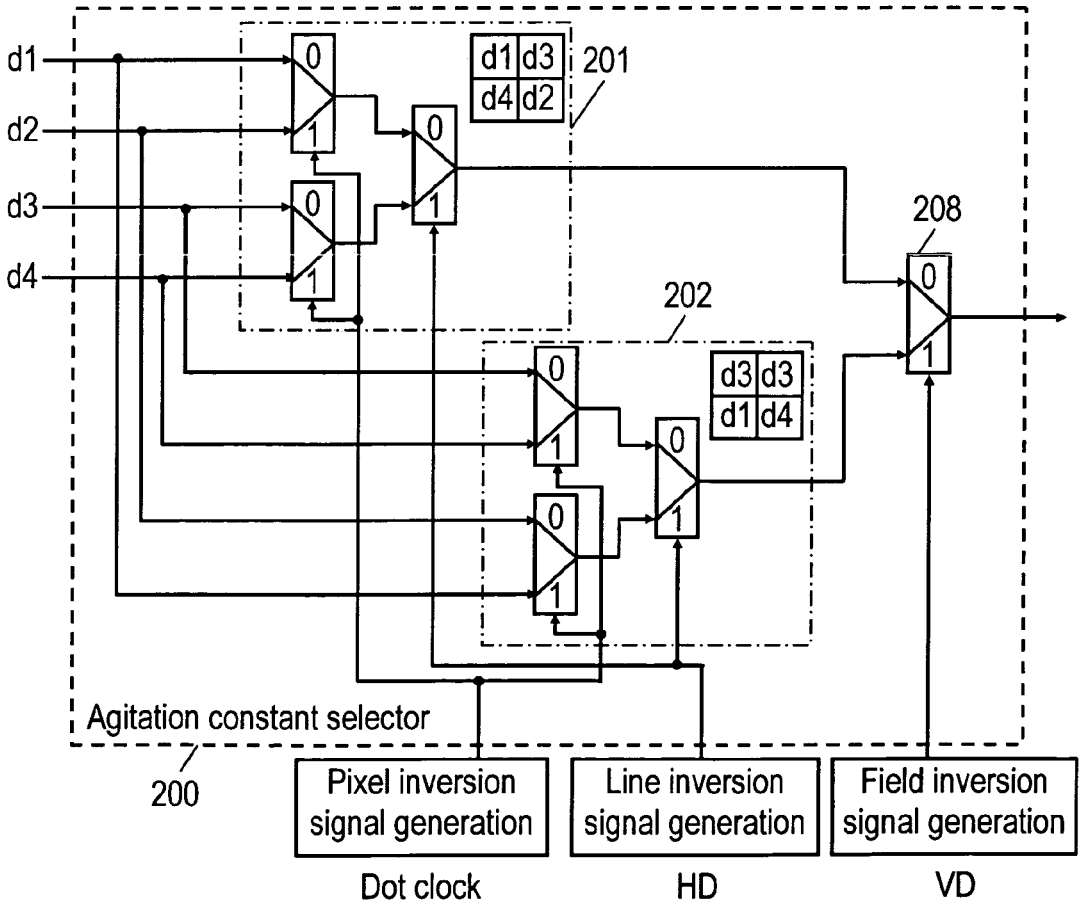
FIG. 8 illustrates an example configuration of an agitation constant selector for the image display apparatus according to embodiments 1 and 2 of the present invention.

FIG. 8 shows an example configuration of agitation constant selector 200 according to embodiment 1. Two agitation constant selectors 201 and 202 shown in FIG. 8 switch four agitation constants according to a pixel inversion signal inverted by pixel and a line inversion signal inverted by line. In this case, agitation constant selector 201 selects a constant so that the matrix arrangement with two pixels by two lines becomes one shown in FIG. 6A for example. Also, agitation constant selector 202 selects a constant so that the matrix arrangement becomes one shown in FIG. 6C for example. Next, selector 208 selects, using a field inversion signal inverted by field, a matrix in FIG. 6A or FIG. 6C alternately to output it for each field. Consequently, agitation constant selector 200, in the first field, selects a matrix in FIG. 6A, paves all over the screen with the matrices as shown in FIG. 6B, and then outputs an agitation constant corresponding to each pixel. Further, in the succeeding fields, the selector selects a matrix in FIG. 6C, paves all over the screen with the matrices as shown in FIG. 6D, and then outputs an agitation constant corresponding to each pixel.

FIG. 9 shows a part of the agitation constant table used in embodiment 1. Agitation constants are set as shown in the columns for agitation constants d1 through d4 for each gradation level of the image signal.

Next, how to determine an agitation constant is described. In embodiment 1, where a matrix with two pixels by two lines are used, four agitation constants d1 through d4 need to be determined for each gradation level. The purpose to add an agitation constant is to disperse dynamic false contours in the gradient gradation-level region, and thus non-emitting subfields in a gradient gradation-level region need to be dispersed. Therefore, an agitation constant to be selected depends largely on a subfield configuration. In the subfield configuration according to embodiment 1, if gradation level 205 is focused for example, the eighth subfield is non-emitted. In this case, for gradation levels 201 through 211, all the eighth subfields are non-emitted. Accordingly, in order to disperse non-emitting subfields, at least one out of four agitation constants d1 through d4 must exceed 211−205=6, and at least one needs to be set to a value smaller than 201−205=−4. Further, the average value of the gradation levels with an agitation constant added is desirably set so that the sum of four agitation constants d1 through d4 becomes zero, in order to be fit for the original gradation. In this case, these agitation constants have been calculated as follows (Where fractions are rounded off.).

d4=(Original gradation level)*0.2 d3=(Original gradation level)*0.1 d2=−d3 d1=−d4

However, besides the above calculation, an agitation constant can be freely set as long as the above-mentioned conditions are satisfied.

As described above, in a gradient gradation-level region, where dynamic false contours particularly tend to occur, dispersing an "intermediate non-emitted subfield" spatially suppresses dynamic false contours. In addition, changing the positions of d1 through d4 in the matrix for each field causes a timewise dispersion, more effectively suppressing dynamic false contours. Meanwhile, in a gradient gradation-level region, a gradation satisfying condition (b) is used as a display-use gradation, and thus retains a sufficient gradation quality, allowing dynamic false contours to be effectively suppressed as a whole, with the gradation quality well retained.

Embodiment 2

Embodiment 2 is different from embodiment 1 in an image signal process for a gradient gradation-level region. The image signal process for a gradient gradation-level region in embodiment 1 does not perform gradation level limiting for an image signal, but adds an agitation constant to all the gradation levels. Meanwhile, the image signal process for a gradient gradation-level region in embodiment 2, in order to disperse dynamic false contours in a gradient gradation-level region more extensively, once performs gradation level limiting and an error diffusion process, then an agitation constant adding process.

Figure 10:
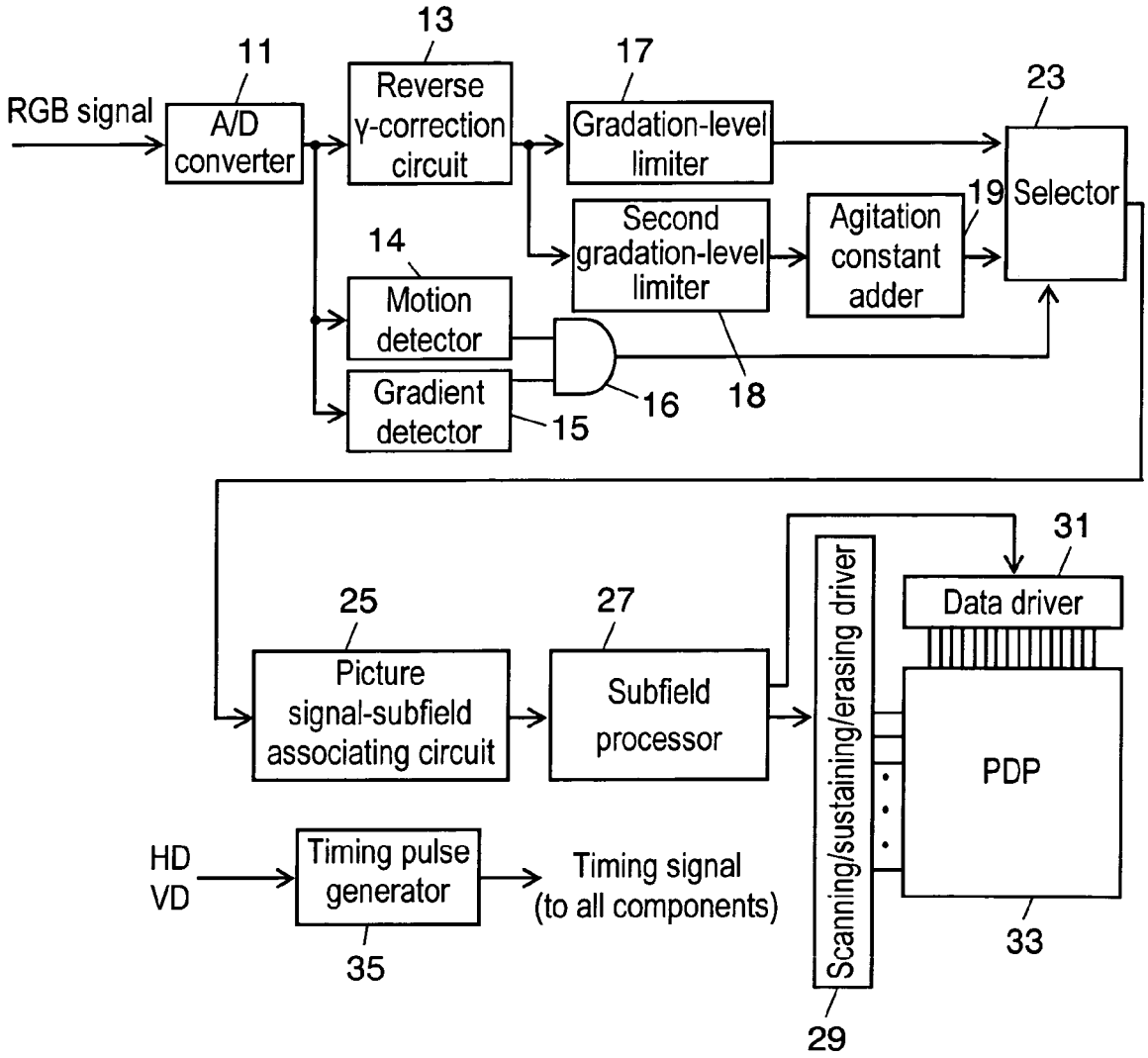
FIG. 10 is a circuit block diagram of the image display apparatus according to embodiment 2 of the present invention.
Figure 12:
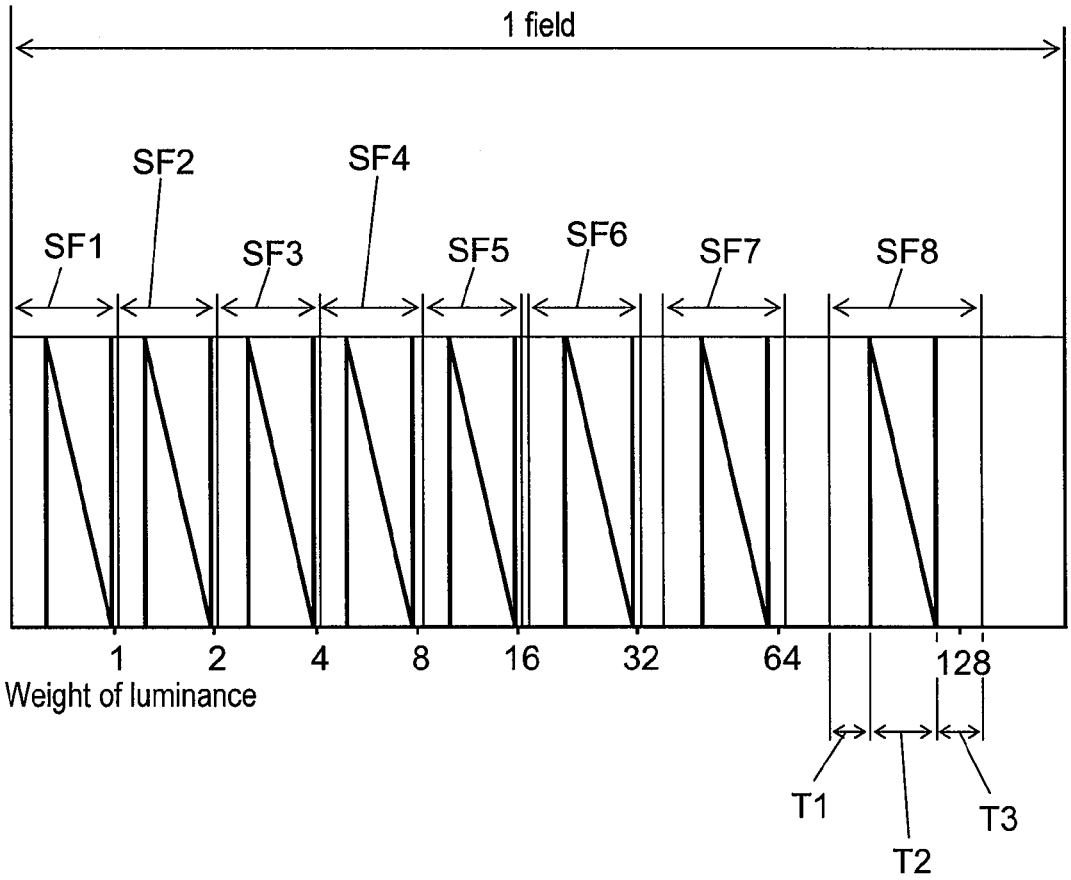
FIG. 12 PRIOR ART
FIG. 12 illustrates an example configuration of subfields in a conventional PDP.
Figure 13:
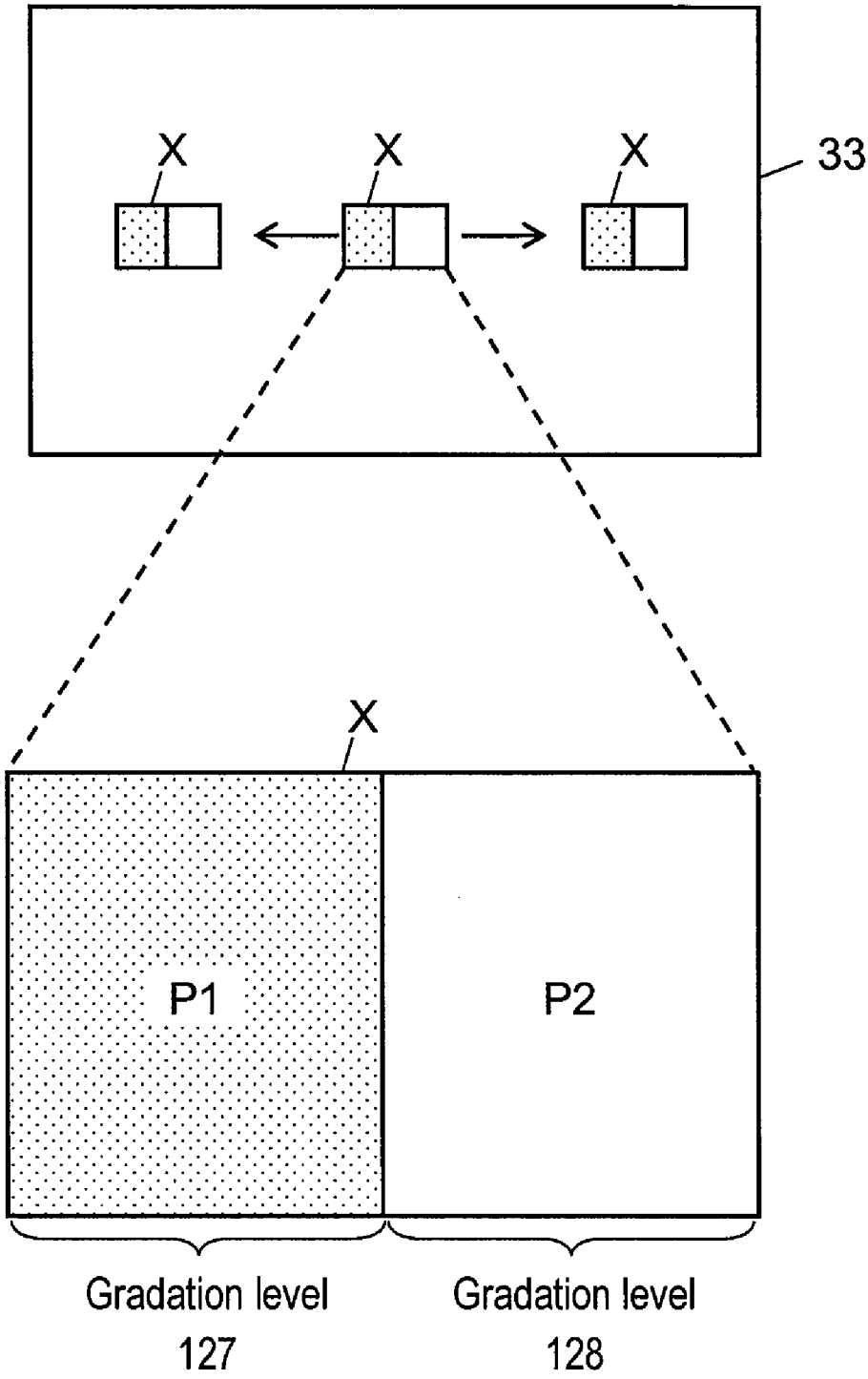
FIG. 13 PRIOR ART
FIG. 13 illustrates a display pattern when dynamic false contours occur.
Figure 14:
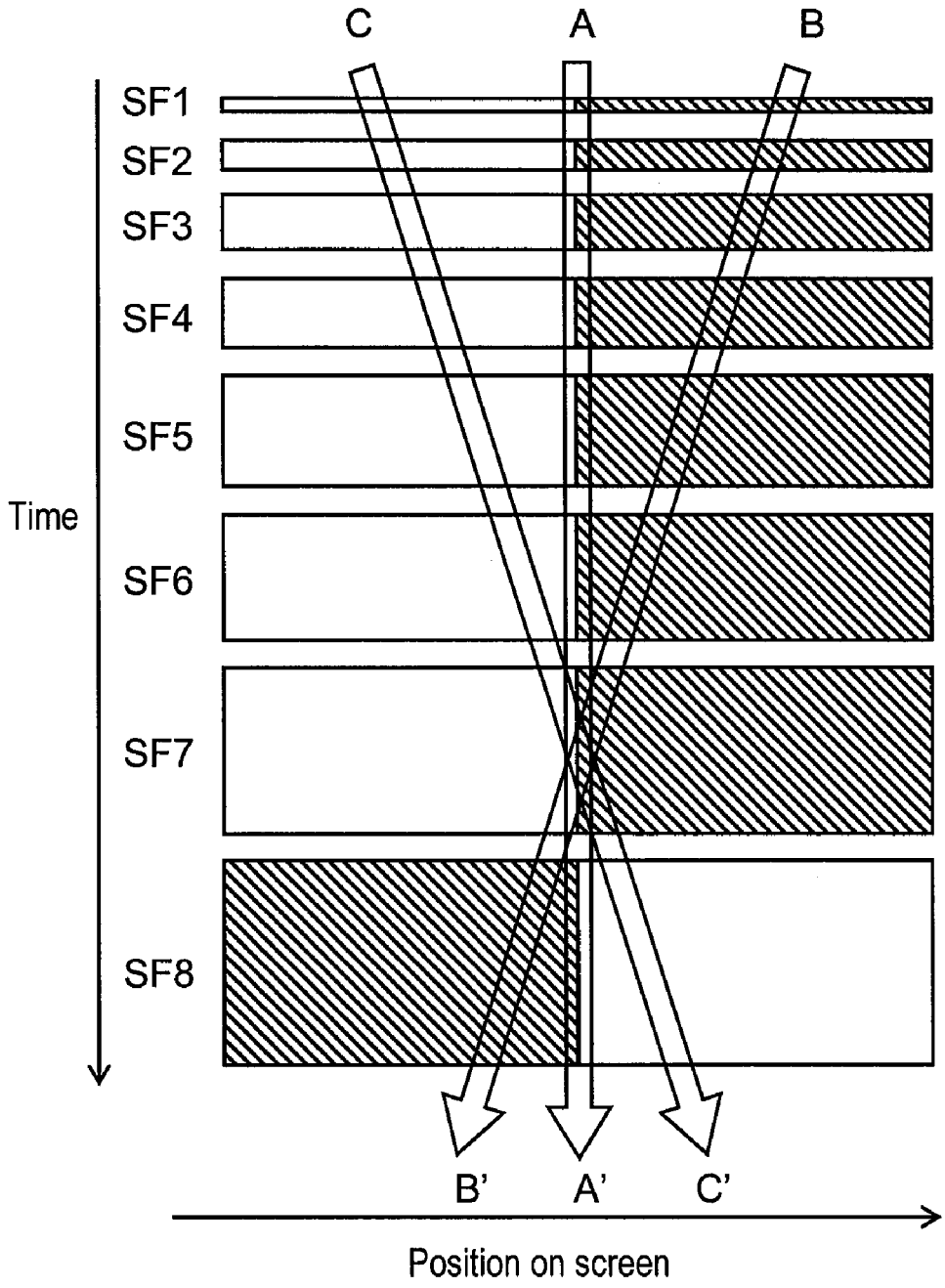
FIG. 14 PRIOR ART
FIG. 14 illustrates a cause for which dynamic false contours occur.

FIG. 10 is a circuit block diagram of an image display apparatus according to embodiment 2. The following components are the same as in embodiment 1: A/D converter 11, inverse gamma correction circuit 13, motion detector 14, gradient detector 15, AND circuit 16, gradation-level limiter 17 and selector 23. Embodiment 2 differs from embodiment 1 in that a inverse-gamma-corrected image signal, via second gradation-level limiter 18 for limiting a gradation level, is input to agitation constant adder 19 for adding an agitation constant. A description on image signal-subfield associating circuit 25 and after is omitted because it is same as in embodiment 1.

FIGS. 11A and 11B show gradation levels limited by the second gradation-level limiter 18, and agitation constants corresponding to their respective gradation levels.

In embodiment 2, although 36 gradation levels quartered from gradation levels (1, 3, 7, 15, 31, 56, 90, 134, 189, and 255) are used as limited gradation levels, gradation levels other than these may be used. However, too few limited gradation levels cause roughness, and contrarily, too many reduce the dispersion range of dynamic false contours, and thus a proper setting with an experiment or the like is required. In addition, for a dark image, with a high visibility in response to the change in gradation levels, it is desirable to arrange a short gradation level interval for a low-level gradation, and long gradation level interval for a high-level gradation.

Next, how to determine an agitation constant is described. Even in embodiment 2, where a matrix with two pixels by two lines is used, four agitation constants d1 through d4 are determined for respective limited gradation levels. The purpose to add an agitation constant is to disperse dynamic false contours in a gradient gradation-level region, and so the agitation constant needs to have such a size that it disperses a non-emitting subfield in a gradient gradation-level region. Further, the average value of the gradation levels with an agitation constant added is desirably set so that the sum of four agitation constants d1 through d4 becomes zero, in order to be fit for the original gradation levels.

In this case, these agitation constants have been calculated as follows:

d4=(Gradation level greater than the original by two levels out of limited gradation levels)−(Original gradation level)

d3=(Gradation level greater than the original by one level out of limited gradation levels)−(Original gradation level)

d2=−d3 d1=−d4

However, besides the above calculation, an agitation constant can be freely set as long as the above-mentioned conditions are satisfied.

In embodiment 2, gradation-level limiter 17 and second gradation-level limiter 18 in FIG. 10 are configured as two independent circuits, however, one gradation-level limiter may be substituted for these circuits, where the content of the gradation level table is rewritten according to the output from AND circuit 16. In this case, for a non-gradient gradation-level region, an implement needs to be added for disabling the function of the agitation constant adder, using the output from AND circuit 16.

As described above, in a gradient gradation-level region, where dynamic false contours particularly tend to occur, by adding the processes for gradation level limiting and error dispersion, "intermediate non-emitted subfield" is spatially dispersed more extensively, and dynamic false contours are suppressed. Meanwhile, in a non-gradient gradation-level region, a gradation satisfying condition (b) is used as a display-use gradation, and thus retains a sufficient gradation quality, allowing dynamic false contours to be effectively suppressed as a whole, with the gradation quality well retained.

In embodiments 1 and 2, the size of the matrix is two pixels by two lines, but a matrix with an arbitrary size of n pixels by m lines may be used, where (n by m) of agitation constants are set for each gradation level.

Further, even in a moving gradient gradation-level region, if the luminance is low, dynamic false contours are unlikely to be perceived, and thus performing a process for adding an agitation constant is also acceptable in a moving gradient gradation-level region, and also for a region with some level of luminance gradation.

INDUSTRIAL APPLICABILITY

As described above, according to the present invention, in a non-gradient gradation-level region, because a gradation satisfying condition (b) is used as its display-use gradation, a sufficient gradation quality is retained. Meanwhile, in a gradient gradation-level region, where dynamic false contours tend to occur, the contours can be spatially dispersed extensively, thus suppressing the contours with sufficient gradation levels secured. Accordingly, an advantage is achieved where dynamic false contours can be effectively suppressed as a whole, with the gradation quality well retained.

The invention claimed is:

1. An image display apparatus, which forms fields each comprising a plurality of subfields and displays a multilevel gradation by controlling each of the subfields to be emitted or non-emitted, comprising:

an agitation adder for adding an agitation constant to an image signal, the agitation adder including:

an agitation constant generator for generating at least four agitation constants for each gradation level, the at least four agitation constants independently generated based on each gradation level in a plurality of arrangements for each gradation level corresponding to the image signal;

an agitation constant selector for selecting one agitation constant out of the at least four agitation constants arranged in the plurality of arrangements based on a configuration of the plurality of subfields of each field; and an adder for adding the agitation constant selected by the agitation constant selector, to the image signal.

2. An image display apparatus as claimed in claim 1, wherein a sum of the at least four agitation constants for each arrangement is zero.

3. An image display apparatus as claimed in claim 1, wherein at least one of the agitation constants is approximately 20% of the gradation level for each of the gradation levels and at least another one of the agitation constants is approximately 10% of the gradation level for each of the gradation levels.

4. An image display apparatus, which forms fields each comprising a plurality of subfields and displays a multilevel gradation by controlling each of the subfields to be emitted or non-emitted, comprising:

a gradation-level limiter for limiting an image signal to a plurality of gradation levels, and for diffusing a difference caused by the limiting as a display error, to a surrounding pixel; and an agitation adder for adding an agitation constant to an image signal limited by the gradation-level limiter, the agitation adder including:

an agitation constant generator for generating at least four agitation constants for each gradation level, the at least four agitation constants independently generated based on each gradation level in a plurality of arrangements for each gradation level corresponding to an image signal limited by the gradation-level limiter;

an agitation constant selector for selecting one agitation constant out of the at least four agitation constants arranged in the plurality of arrangements based on a configuration of the plurality of subfields of each field; and an adder for adding the agitation constant selected by the agitation constant selector, to the image signal.

5. An image display apparatus as claimed in claim 4, wherein a sum of the at least four agitation constants for each arrangement is zero.

6. An image display apparatus as claimed in claim 4, wherein at least one of the agitation constants is approximately 20% of the gradation level for each of the gradation levels and at least another one of the agitation constants is approximately 10% of the gradation level for each of the gradation levels.

* * * * *